US011927026B2

(12) United States Patent
Baker

(10) Patent No.: US 11,927,026 B2
(45) Date of Patent: Mar. 12, 2024

(54) POLE STABILIZATION ASSEMBLY

(71) Applicant: Brandon W Baker, Waco, TX (US)

(72) Inventor: Brandon W Baker, Waco, TX (US)

( * ) Notice: Subject to any disclaimer, the term of this patent is extended or adjusted under 35 U.S.C. 154(b) by 0 days.

(21) Appl. No.: 16/819,915

(22) Filed: Mar. 16, 2020

(65) Prior Publication Data

US 2021/0285251 A1 Sep. 16, 2021

(51) Int. Cl.

| | |
|---|---|
| ***E04H 12/20*** | (2006.01) |
| ***E02D 5/80*** | (2006.01) |
| ***E02D 27/42*** | (2006.01) |
| ***E04G 17/14*** | (2006.01) |
| ***E04G 21/26*** | (2006.01) |

(52) U.S. Cl.

CPC ..... *E04H 12/20* (2013.01); *E02D 5/803* (2013.01); *E02D 27/42* (2013.01); *E02D 2600/30* (2013.01); *E04G 17/14* (2013.01); *E04G 21/26* (2013.01)

(58) Field of Classification Search

CPC ..... E04H 12/20; E02D 5/803; E02D 27/42; E02D 2600/30; E04G 21/26; E04G 17/14

See application file for complete search history.

(56) References Cited

U.S. PATENT DOCUMENTS 2,510,717 A * 6/1950 Roos ..... E04G 21/163 269/46
2,741,821 A * 4/1956 Findley ..... E04G 17/14 248/354.3
3,229,950 A * 1/1966 MacRobbie ..... E04G 21/26 248/354.5
4,068,427 A * 1/1978 Camardo ..... E04G 21/26 52/749.1
4,083,156 A * 4/1978 Tye ..... E04G 21/26 403/379.5
5,317,844 A 6/1994 Legler
5,337,530 A * 8/1994 Beames ..... E04B 2/8652 52/426
5,622,354 A * 4/1997 Chagnot ..... E04G 21/26 254/100
6,439,344 B1 * 8/2002 Cole ..... A62B 35/0068 182/113
6,539,677 B1 * 4/2003 Lanka ..... E04G 17/002 248/354.3
6,976,339 B1 * 12/2005 Riccio ..... E04G 21/1841 248/354.1
8,733,728 B2 * 5/2014 Reilly ..... E04G 17/14 249/219.1

(Continued)

*Primary Examiner* — Brian D Mattei
*Assistant Examiner* — Omar F Hijaz
(74) *Attorney, Agent, or Firm* — Law Office of Jeff Williams PLLC; J. Oliver Williams

(57) ABSTRACT

A post stabilization system which uses components which allow for both pushing and pulling forces to be applied to a workpiece in situ. The system uses the ground as an anchor point to stabilize a workpiece being installed. A force application member is connected to an anchoring device at one end. The opposing end of the force application member is an abutment member for applying a stabilizing force to a pole or other vertically oriented workpiece. An adjustment/tensioning member is applied between the anchoring device and the abutment member to allow for adjusting the angle of the workpiece by applying either pushing or pulling forces to the workpiece.

4 Claims, 3 Drawing Sheets

(56) References Cited

U.S. PATENT DOCUMENTS

| | | | | |
|---|---|---|---|---|
| 9,103,090 | B2 | 8/2015 | Bushore | |
| 9,243,419 | B2 | 1/2016 | Niidome et al. | |
| 9,739,070 | B2 | 8/2017 | Bushore | |
| 2004/0075040 | A1* | 4/2004 | Scallan | E04G 17/14<br>249/191 |
| 2007/0175174 | A1* | 8/2007 | Bruno | E04G 17/14<br>52/745.12 |
| 2011/0068568 | A1* | 3/2011 | Cerezo Lotina | B61D 45/00<br>285/32 |
| 2011/0079698 | A1* | 4/2011 | Pezzimenti | E04G 21/26<br>248/354.5 |
| 2011/0173918 | A1* | 7/2011 | Graham | E04G 21/26<br>52/693 |
| 2018/0258655 | A1* | 9/2018 | Reitano | B25B 5/003 |

* cited by examiner

POLE STABILIZATION ASSEMBLY

BACKGROUND OF THE INVENTION

Field of the Invention

The present invention concerns pole stabilizing assemblies. More particularly, the invention is directed to an improved temporary utility pole support assembly utilizing inexpensive components in a novel arrangement.

Description of the Prior Art

Temporary pole support assemblies for supporting utility poles and the like while, e.g., permanently situating the pole in the ground are known. The assemblies are typically expensive. For example, sometimes concrete anchors are used to temporarily support telephone poles during the installation process. The problem with concrete anchors is that they are large, heavy, and therefore difficult to transport. Also, because of the size and weight, a work crew can only transport a limited number at a time. Finally, the anchors themselves are expensive. Another way of temporarily supporting utility poles is to use a hoist. Hoists are also large and expensive and thus suffer the same drawback as the concrete anchors. Hoists suffer from the additional drawback in that they can only pull and cannot push, which complicates adjustments to the pole, i.e., makes it more difficult to straighten.

Accordingly, it is desirable to provide a pole stabilization system which is particularly designed for installing large poles like utility poles. The system uses components which allow for both pushing and pulling forces to be applied to a workpiece in situ. The system uses the ground as an anchor point to stabilize a workpiece being installed. A force application member is connected to an anchoring device at one end. The opposing end of the force application member is an abutment member for applying a stabilizing force to a utility pole or other vertically oriented workpiece. An adjustment/tensioning member is applied between the anchoring device and the abutment member to allow for adjusting the angle of the pole by applying either pushing or pulling forces to the workpiece.

SUMMARY OF THE INVENTION

It is a major object of the invention to provide an improved workpiece stabilizing system.

It is another object of the invention to provide an improved workpiece stabilizing system which is lightweight and portable.

It is another object of the invention to provide an improved workpiece stabilizing system which uses the ground as an anchor.

It is another object of the invention to provide an improved workpiece stabilizing system that can apply both pushing and pulling forces to the workpiece.

Finally, it is a general goal of the invention to provide improved elements and arrangements thereof in an apparatus for the purposes described which is dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered with the accompanying drawings, in which like reference characters designate the same or similar parts throughout the several views, and wherein.

DETAILED DESCRIPTION OF THE PREFERRED EMBODIMENTS

Figure 1:
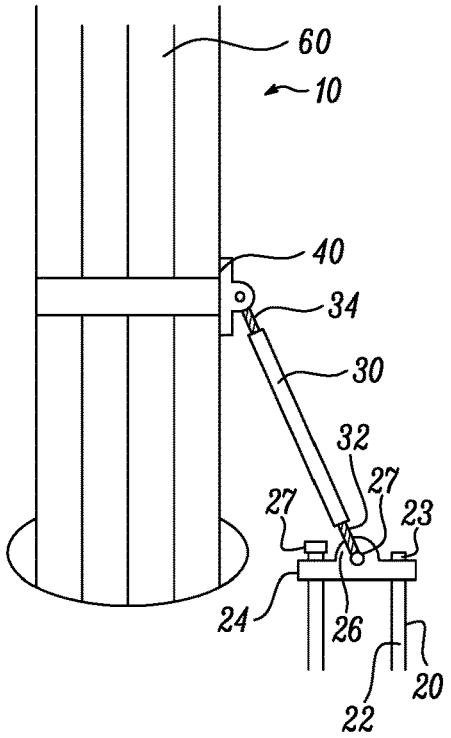
FIG. 1 shows a perspective view of the stabilizing system of the invention positioned on a workpiece.
Figure 2:
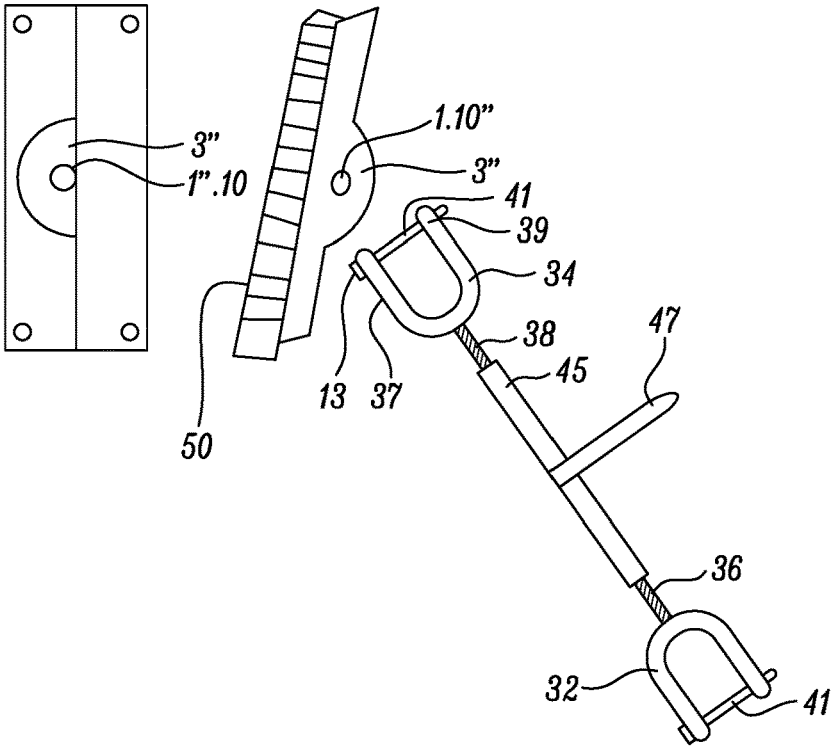
FIG. 2 shows an exploded side view of the adjustable force application member of the invention.
Figure 3:
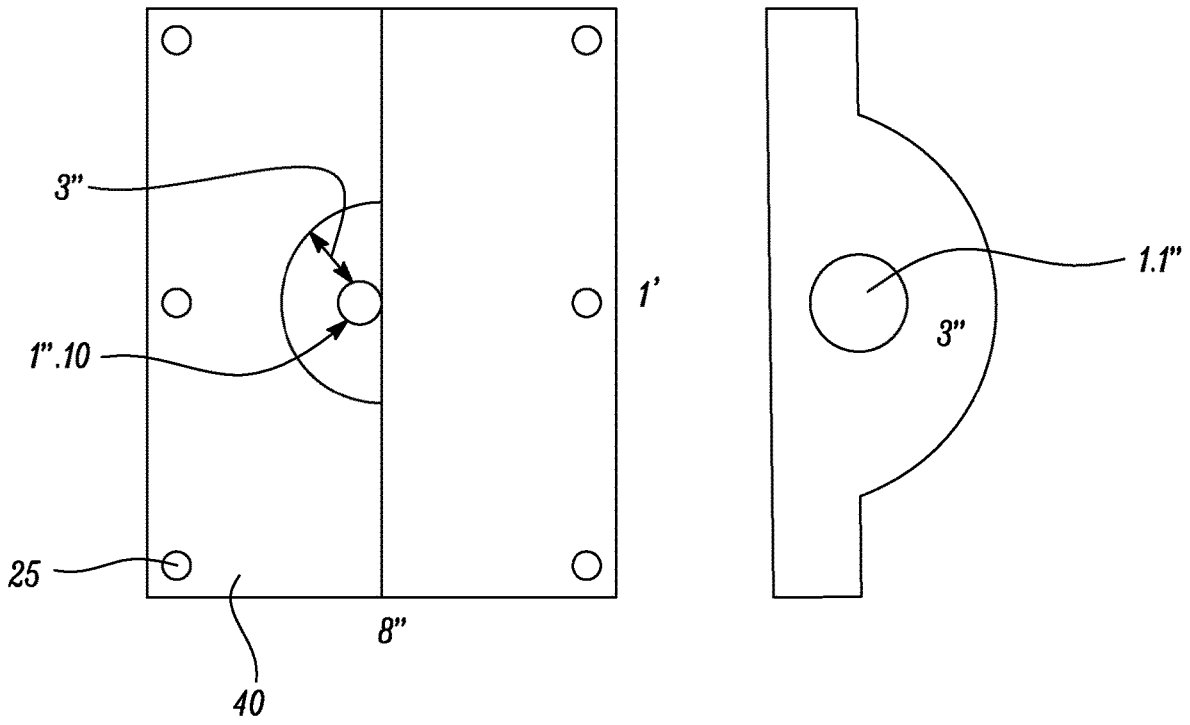
FIG. 3 shows a plan view an abutment member of the invention.

Referring now to FIGS. 1-3, the system of the present invention, generally indicated by the numeral 10, is shown. It can be seen that the system 10 has three main components; an anchoring device 20, an adjustable force application member 30, an abutment member 40.

It should first be noted that all of the components of the system 10 are relatively small, and lightweight to allow for portability. The components are all made of a heavy durable material like steel or other metals or engineered equivalent materials. The base or anchoring device 20 includes anchoring members 22 or spikes which are driven into the ground. The anchoring members 22 are steel tent spikes which are appropriately dimensioned to in accordance with the size and the weight of the workpiece. Heavy duty spikes are used for very heavy workpieces such as utility poles as would be apparent to one of skill in the art, the depth of the implantation, firmness of the surrounding soil etc. also being factors to consider. An attachment plate 24 having apertures 25 sized for the insertion of spikes 22 therethrough is used to stabilize and strengthen the anchoring device 20. The apertures are positioned at the corners of the substantially rectangular plate 24. Each spike 22 has a head 27 with an abutment collar 23 to prevent the stake 22 from sliding through the aperture 25. The head 27 may be threaded or otherwise configured for attachment to the plate 24. The attachment plate 24 is of the same construction as the abutment device as will be discussed later. A flange 26 positioned on the top of the attachment plate 24 includes an attachment aperture 27 for attaching to one end of the force application member 30.

The force application member 30 is a modified turnbuckle assembly, adapted to provide stabilizing support to a vertical workpiece being positioned in the ground. A turnbuckle is a device for adjusting the tension or length of ropes, cables, tie rods, and other tensioning systems. It normally consists of two threaded eye bolts, one screwed into each end of a small metal frame, one with a left-hand thread and the other with a right-hand thread. The tension can be adjusted by rotating the frame, which causes both eye bolts to be screwed in or out simultaneously, without twisting the eye bolts or attached cables. In the place of the conventional eyebolts, the force application member 30 of the invention uses an opposing pair of modified U-connectors 32, 24. The connectors 32, 34 may be connected as by welding to respective elongated threaded members 36, 38, but preferably connectors 32, 24 and threaded members 36, 38 are of unitary construction for example by casting for maximum strength. The top ends 37 of the connectors 32, 34 have aligned apertures 39 for the insertion of a bolt 41. The bolts 41 have at least one threaded end so that a nut 43 or other fastener may be used to secure the bolt 41 in place. The bolts 41 on connectors 32, 34 are sized for insertion into and through an aperture in order to effect connection.

The frame 45 of the force member 30 is conventional, and threaded members 36, 38 are configured so that rotation of the frame causes inward (pulling) and outward (pushing) forces to be applied by connectors 32, 34. A rotatable handle 47 is securely attached to frame 45 to allow for more torque or turning force to be applied to the frame 45, which is useful when dealing with very heavy workpieces such as utility poles. The handle 47, like the frame 45, can be rotated in either direction to effect pushing or pulling forces.

An abutment member 40 is connected to connector 34, the abutment member 40 being of the same size, shape and configuration as attachment plate 24, except that a removable friction pad 50 is attached thereto. Friction pad 50 may be attached by glue or any other secure means. Thus the abutment member 40 and attachment plate can be used interchangeably with the addition/subtraction of friction pad 50, this arrangement having the advantage of reducing manufacturing costs of the device 10.

In use, first a user will secure stakes 22 into the ground using a sledgehammer or other means, with attachment plate 24 preferably used to effect alignment and spacing of the stakes 22. Once the stakes 22 are fully inserted and attached to attachment plate the base 20 is secure. The user then attaches force application member 30 to the base via connector 32. After attaching abutment member 40 to connector 34, abutment member 40 is positioned as shown in FIG. 1 to apply force to workpiece 60, in this case a utility pole. Using one or more of the inventive device 10, the user may then adjust the angle of the workpiece 60 by turning handle 47 on one or more devices.

Figure 4:
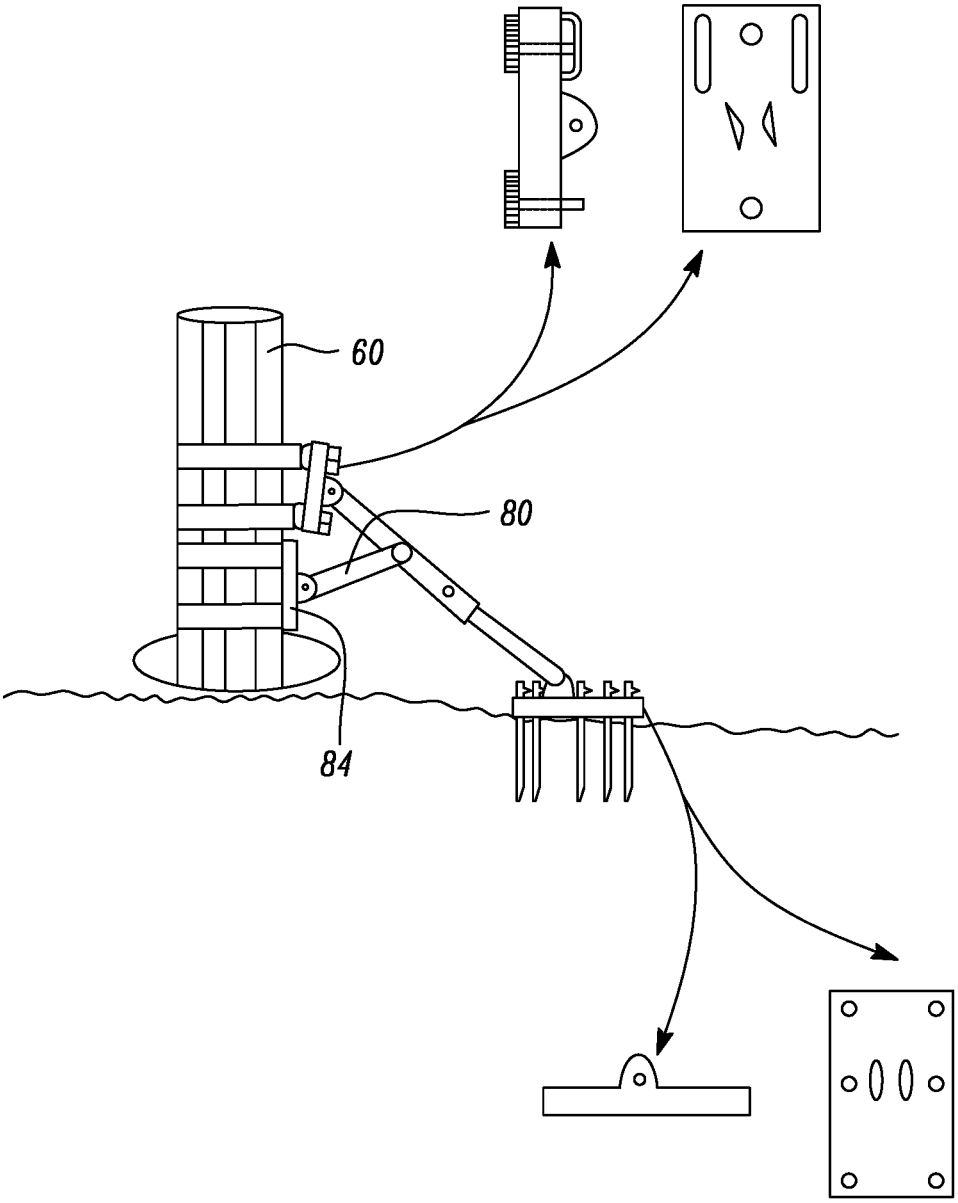
FIG. 4 shows a side view of an alternative embodiment of the system of the invention.

Referring now to FIG. 4 an alternative embodiment is shown. In this embodiment, an additional stabilizing arm 80 extends from the device 10, the stabilizing arm 80 having an abutment member 84 attached thereto in the same manner as discussed above. The abutment member 84 is configured in the same manner as abutment member 40, with stabilizing arm 80 allowing for vertical spacing of the abutment members 40, 84. This spaced relation serves to prevent the tendency of the workpiece 60 to tilt or slide out from the bottom, especially when there is groundwater in the hole dug for the workpiece. The angle formed between the stabilizing arm 80 and the force application member 30 is variable but is in the range of 30 to 60 degrees.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A workpiece stabilizing system comprising: one or more temporary stabilizing devices, each device having a base, a force application member having a first end and an opposing end, a stabilizing arm coupled to the force application member between the first end and the opposing end for coupling to a workpiece, and an abutment member, the abutment member having a removable friction pad;

each of said bases including an attachment plate which is secured parallel to the ground by stakes;

said force application member first end connecting to a pair of concentric singular apertures of said plate, and said opposing end connecting to a pair of concentric singular apertures of said abutment member, the force application member including a pair of U-connectors each having aligned apertures for insertion of a bolt, each bolt passing through the singular apertures of the plate and the abutment member, the force application member including a handle for effecting a pulling or pushing force by way of rotation, the handle configured to rotate about a frame of the force application member so as to selectively be a lever extending away from the force application member and to increase turning forces on the force application member; and the stabilizing arm having a second abutment member coupled to an abutment end and being coupled to the force application member at a coupling end, the second abutment member including a second removable friction pad;

whereby said workpiece stabilizing system may be stabilized and positioned angularly by turning the handle on one or more of said stabilizing devices.

2. The system of claim 1 wherein said attachment plate and said abutment member can be used interchangeably.

3. The system of claim 1 including a stabilizing arm extending from said force application member.

4. The system of claim 1 wherein at least two of said stabilizing devices are deployed.

* * * * *